US007073918B1

(12) United States Patent
Bauman

(10) Patent No.: US 7,073,918 B1
(45) Date of Patent: Jul. 11, 2006

(54) COMPACT MULTIFUNCTION TOOL FOR USE WITH COMPUTERS

(76) Inventor: Evan George Bauman, 2241 Del Monte, Houston, TX (US) 77019

( * ) Notice: Subject to any disclaimer, the term of this patent is extended or adjusted under 35 U.S.C. 154(b) by 105 days.

(21) Appl. No.: 10/962,034

(22) Filed: Oct. 8, 2004

Related U.S. Application Data

(60) Provisional application No. 60/510,061, filed on Oct. 9, 2003.

(51) Int. Cl.
*B25F 1/00* (2006.01)
*B25B 25/00* (2006.01)

(52) U.S. Cl. ..... 362/119; 362/800; 7/107; 7/108; 7/118; 81/488

(58) Field of Classification Search ..... 362/119
See application file for complete search history.

(56) References Cited

U.S. PATENT DOCUMENTS 4,238,862 A 12/1980 Leatherman ..... 7/128
4,854,045 A 8/1989 Schaub ..... 30/155
5,062,173 A 11/1991 Collins ..... 7/118
5,313,376 A 5/1994 McIntosh ..... 362/119
5,664,274 A 9/1997 Collins ..... 7/129

*Primary Examiner*—Renee Luebke
*Assistant Examiner*—Leah Lovell
(74) *Attorney, Agent, or Firm*—Buskop Law Group, P.C.; Wendy Buskop

(57) ABSTRACT

The invention is a compact multiple function tool for use with computer systems made of a housing having a front plate and a back plate and an overall length of less than three inches, separated by interior plates connected by pivots and a unit of numerous implements including a miniature flashlight, a chip puller, a first screwdriver having a small Phillips head with a length less than two inches, a second screwdriver forming a small flat head with a length less than two inches, a continuity tester with a miniature indicator light, a miniature wire stripper, a miniature crimper, and a laptop case cracker, wherein the implements are pivotally coupled to the housing and the miniature flashlight is positioned on the front plate of the tool.

16 Claims, 6 Drawing Sheets

COMPACT MULTIFUNCTION TOOL FOR USE WITH COMPUTERS

The present application claims priority to co-pending U.S. Provisional Patent Application Ser. No. 60/510,061, filed on Oct. 9, 2003.

FIELD OF THE INVENTION

The present invention relates generally to the field of multiple function compound tools, and in particular to a tool for working on computers and computer systems adapted for use in conjunction with a briefcase and similar business travel accessories.

BACKGROUND OF THE INVENTION

On occasion, travelers have a need for various computer tools and other implements to address diverse computer situations. For example, business travelers typically use timepieces and writing implements in order to conduct business, for example, in meetings and conferences. Further, business travelers may need eyeglass repair implements in the event that one must repair one's eyeglasses in order to conduct business.

While such implements may typically be small in size for ease of carrying and of use, it is cumbersome to carry multiple individual implements in one's attire and/or carrying cases, particularly in the case of computer tools that can become heavy.

Furthermore, the small size of such implements, when separated, may also cause such tools to be difficult to locate in a carrying case or in one's attire, including one's pockets. Alternatively, multiple implements such as continuity testers have to be safely stored so as not to be broken. However, such connected combinations of individual and disparate implements may be unwieldy to manipulate and store in one's attire or carrying cases.

Compound, multiple function tools having foldable and/or retractable tools are known in the art. Such tools may be pivoted into and out of a predetermined channel within at least one handle of the combination tool for selective use. For example, Leatherman U.S. Pat. No. 4,238,862 describes a pocket multiple tool having an initially folded compact shape which folds out to produce a pair of pliers as well as a nail file, miniature scissors, a permanently magnetized Phillips-type screwdriver, a bottle opener, and small and medium screwdriver bits. Also, Schaub U.S. Pat. No. 4,854,045 describes a modular pocketknife having electronic components such as a display and entry keyboards as well as a radio receiver. McIntosh U.S. Pat. No. 5,313,376 has a multipurpose knife with an attachable flashlight. Also, "SWISS ARMY" knives are available, for example, through catalog sales such as "NORM THOMPSON" which have a combination of golf tools, knife, bottle opener, screwdriver, and removable tweezers and toothpick.

However, although combination tools may provide a variety of different implements, the user is generally limited by the tools that are available from a given combination tool for a primary purpose of the tool. For instance, many of such compounds, multiple function tools are general-purpose tools, primarily adapted for non-business travel, such as camping and hiking and certainly not for computer component use. For example, cutting implements and eating implements are typically provided such as knives and can openers.

Current combination tools do not have the appropriate tools for business travelers who are in the computer repair and network servicing businesses and these do not address the specific needs that may occur to the everyday information technology person.

Further, a business information technology traveler may require such business-oriented implements, but may not have the space on one's person to carry many of such implements. Miniature versions of individual business-oriented implements have the deficiencies described above; that is, such miniature versions may be easy to misplace or lose, and combinations of individual implements may be unwieldy.

Accordingly, there has been a long felt need for business-oriented tools that are sufficiently compact to fit into a briefcase and/or other business travel accessories, such as a purse, a travel bag, a pocket, a glove compartment of a vehicle, a pouch worn about one's waist or other portions of the body, Current combination tools have not provided such combinations of business-oriented tools in a compact form for carrying within such business travel accessories. A need exists for such small tools.

This tool meets these needs.

BRIEF DESCRIPTION OF THE DRAWINGS

The detailed description will be better understood in conjunction with the accompanying drawings, wherein like reference characters represent like elements, as follows.

DETAILED DESCRIPTION OF THE PREFERRED EMBODIMENTS

Figure 1:
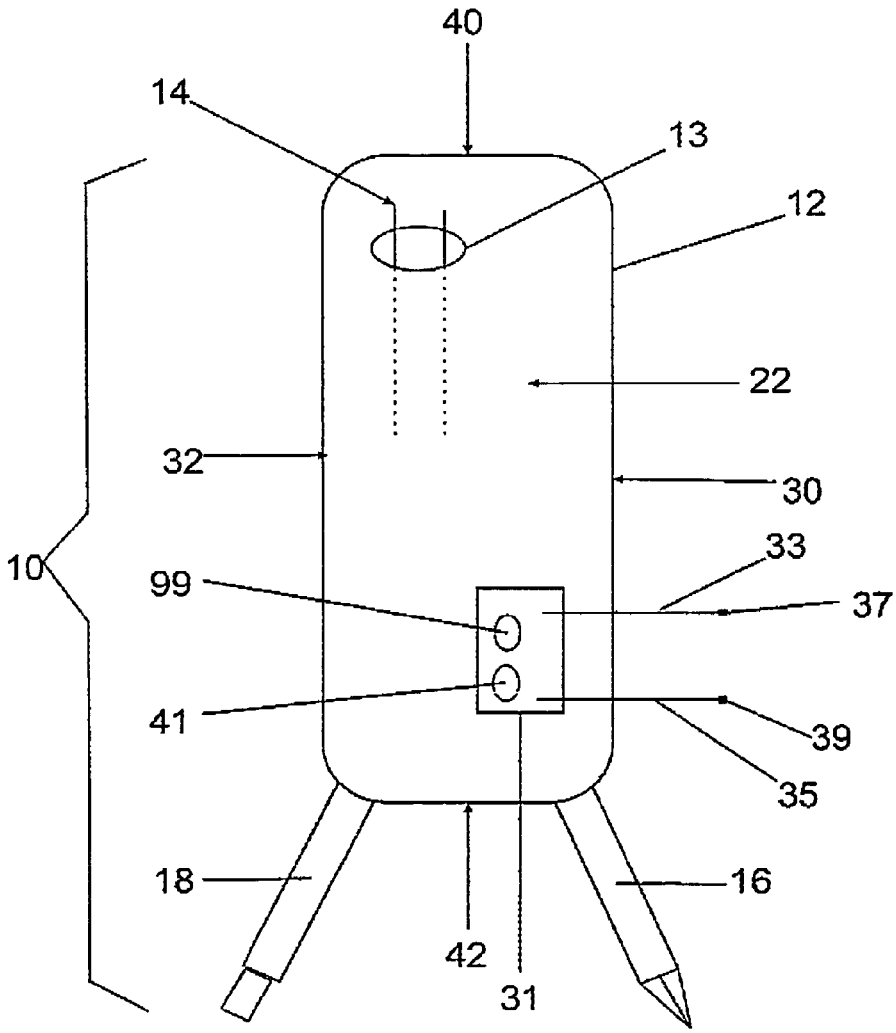
FIG. 1 is a view of a front plate cover.

While this invention has been described with emphasis on the preferred embodiments, it should be understood that within the scope of the appended claims, the invention might be practiced other than as specifically described herein.

It is recognized herein that, for many diverse business-oriented travel needs, a multiple function combination tool may be implemented which provides the versatility of use for business travel purposes, and which has a compact and reduced size to fit within a briefcase and/or other business travel accessories.

Current combination tools have not provided such combinations of business-oriented tools in a compact form for carrying within such business travel accessories. A need exists for such small tools and this tool meets these needs.

The advantages of the present invention will be readily apparent from the following detailed description of the invention, taken in conjunction with the accompanying drawings that illustrate, by way of example, features of the present invention.

In the following detailed description, like reference numerals will be used to refer to the corresponding elements in the different figures of the drawings.

With reference to the Figures, FIG. 1 is a first embodiment of a multi-purpose tool 10 formed in accordance with the principles of the present invention. The Multi-purpose tool 10 has a plurality of additional tools coupled thereto for performing various functions associated with repair of computer equipment, maintenance of networks, and repair and installation of communication equipment such as laptops, fax machines, cash registers, bar scanners, credit card terminals, and the like.

The multi-purpose tool comprises a housing 12 configured to house various combinations of tools and implements that are useful in connection with repair, installation, and maintenance of computer networks, computers, and related equipment.

In a preferred embodiment shown in FIG. 1 there is a front cover plate 22, a housing 12 is formed with a plurality of recesses shaped to receive the tools or implements to be housed by the housing 12. For example, a chip puller 14 can be mounted in the housing 12 in a recess 13 and the chip puller can slide out of the recess. Recess 13 is a generally cylindrical opening into which a chip puller 14 can be generally stored. In FIG. 1, the ends of the housed chip puller are shown slightly extended. A first screwdriver having a small Phillips head 16 can each be pivotably mounted to the housing. A second screwdriver having a small flat head 18 can also be mounted in the housing 12. The length of the small Phillips head 16 and the small flat head 18 is less that 2 inches. Also shown in the figure is a first longitudinal side 30 and second longitudinal side 32. Housing 12 has a first end 40 and a second end 42. Preferably, these ends have rounded corners. The length of the tool is less than 3 inches from first end 40 to second end 42.

A continuity tester 31 with an miniature indicator light 41 is secured to the housing 12. In one embodiment the tester includes a first retractable wire 33 and a second retractable wire 35. Each wire has a contact. First contact 37 is for first retractable wire 33 and second contact 39 is for second retractable wire 35. The contacts connect to the second miniature indicator light 99 to indicate signal continuity in a part or circuit to be tested.

Figure 2:
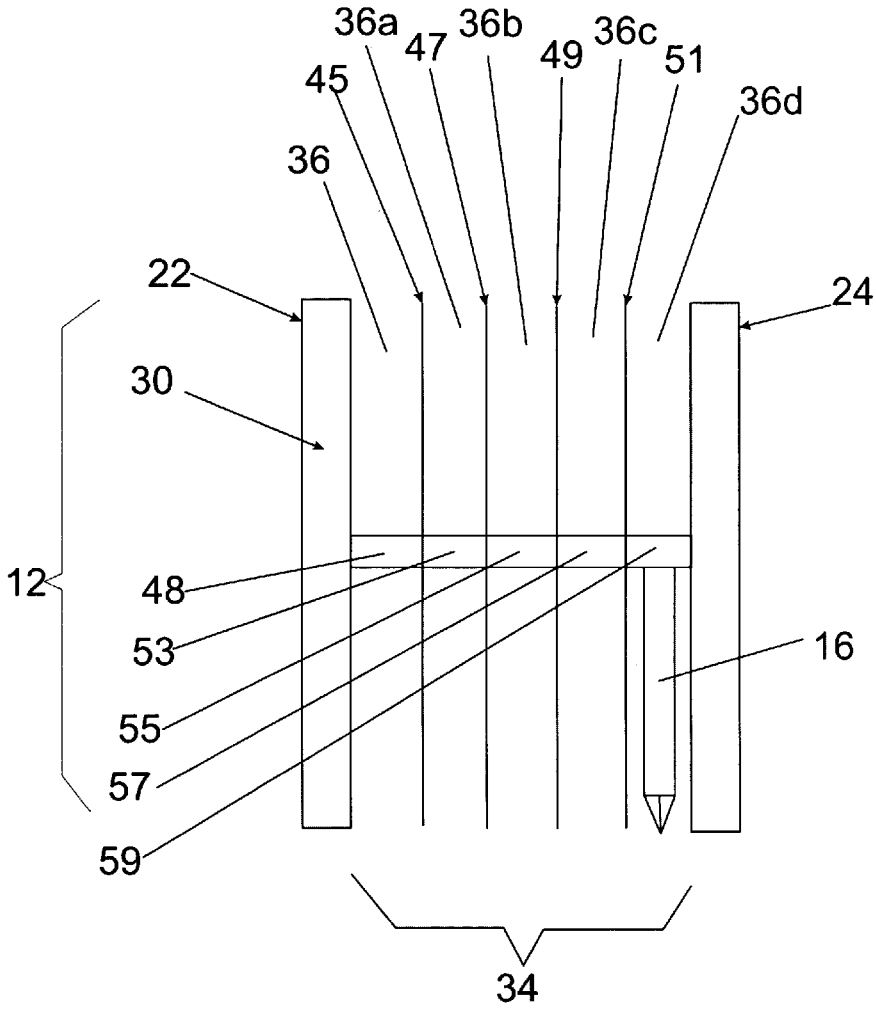
FIG. 2 is a detail of the first longitudinal side of the invention showing the interior plates.

FIG. 2 shows a side view of the invention showing that the housing 12 preferably includes a front cover plate 22 and a back cover plate 24, each of which is preferably elongated, with a generally rectangular cross section. The first longitudinal side 30 includes a longitudinal openings 34. The longitudinal openings 34 shown in FIG. 2 have recesses 36, 36*a*, 36*b*, 36*c*, 36*d*, within housing 12 in which one or more implements or tools may be stored. Similarly, longitudinal side 32 has a second recess that is not shown similar to the first recess 36.

Housing 12 may include a number of additional plates 45, 47, 49, 51 interposed between respective front and back cover plates 22, 24. These plates 45, 47, 49, and 51 are cross-sectional shapes such that housing 12 includes the respective recesses 36, 36*a*, 36*b*, 36*c*, and 36*d* for receiving implements, as described in greater detail below. The respective cover plates 22, 24 of housing 12 are preferably joined together by rivets and have spacers between the plates 48, 53, 55, 57, 59 where the rivets extend through the respective cover plates 22, 24 and any additional plates there between. Some of the rivets, in addition to securely holding the plates together, serve as pivot pins for various pivotably mounted implements, as described below. The rivets that do not serve as pivot pins can be 2.5 mm in diameter, but preferably 4 mm in diameter to provide additional strength for the pivotable mounting.

The first screwdriver 16 preferably is pivotably mounted to the housing 12 via a rivet 48, 53, 55, 57, or 59. Rotation of the screwdriver 16 about its pivot pin 59 permits selective orientation of screwdriver 16 for use. The second screwdriver 18 not shown in FIG. 2 can be pivotably mounted in the same fashion to housing 12.

Figure 3:
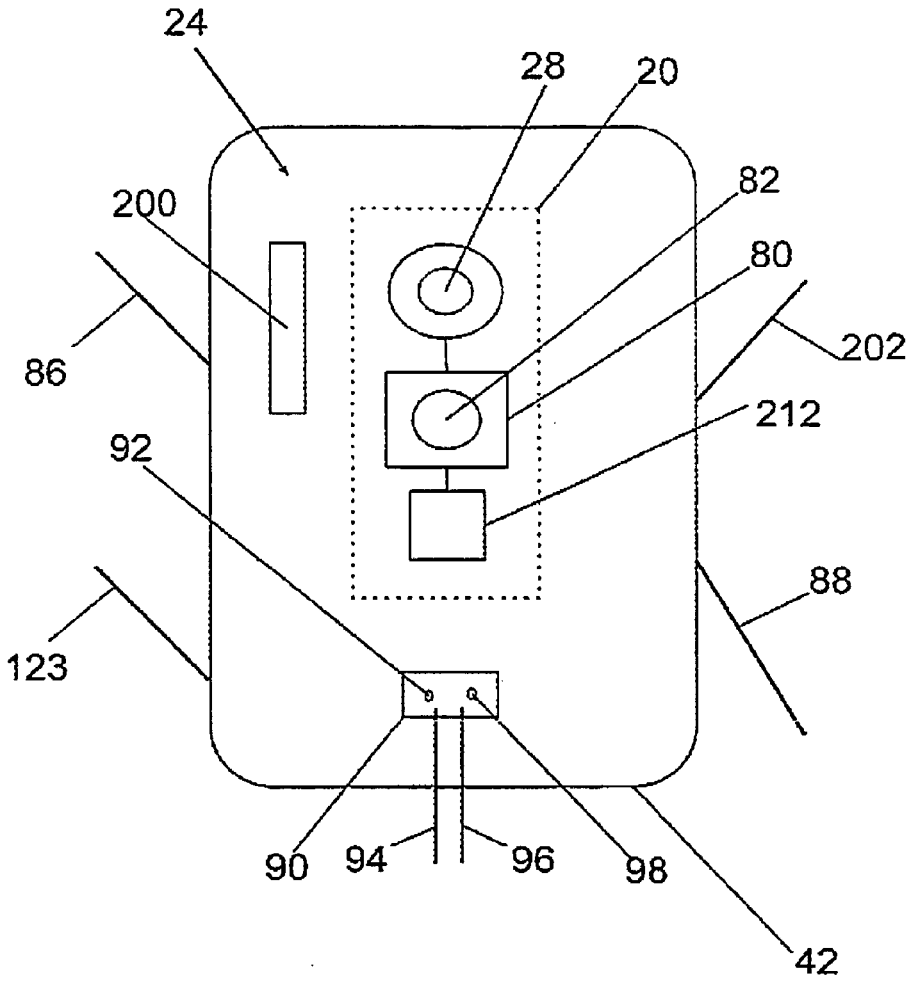
FIG. 3 is a detail of the back view of the invention.

FIG. 3 depicts the back cover plate 24 of the tool. The tool can include a miniature flashlight 20. The miniature flashlight 20 can have a compartment 80 for receiving a battery 82. It is expected that the miniature flashlight and the battery are oriented with respect to each other such that the longitudinal axis of a bulb 28 provided in the miniature flashlight is perpendicular to the longitudinal axis of battery 82.

A wire stripper 123 is an implement usable with this invention. It is preferred that the wire stripper be for 24 gage or smaller wire. A crimper 86 is adapted for Ethernet and telephone cable crimping. A laptop case cracker 88 is included and contemplated as a implement for this tool.

Additionally, an Ethernet connector tester 90 with a connector 92 having a first lead 94 and a second lead 96 and a light indicator 98 for indicating a working Ethernet connection can be built into the tool for indicating a working circuit. It is preferred that the light indicator would be an LED light. A preferred connector would be the well-known RJ45 connector. It is preferred that the connector tester be pivotably coupled to the tool such that pivoting of the tester away from the tool permits access to the connector interior. A password mnemonic 200 can be mounted on the back cover of the tool. Additionally the device can have a cable pin insertion device 202 that can fold into one of the recesses.

Returning to the miniature flashlight shown in FIG. 3, the miniature flashlight can include a miniature flashlight actuator 212 arranged for activating and deactivating the miniature flashlight.

Figure 4:
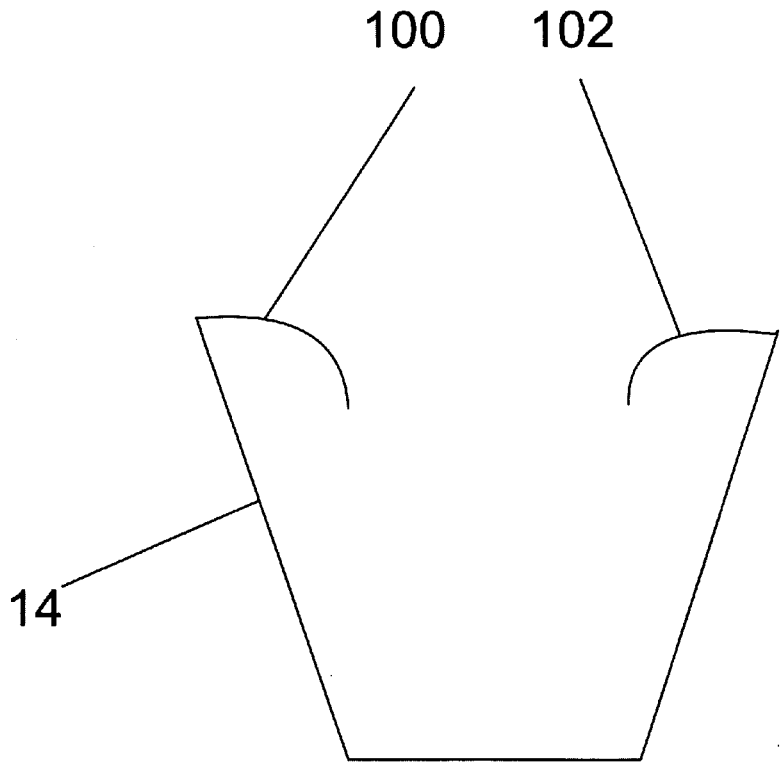
FIG. 4 is a side view of a chip puller used in the invention.

FIG. 4 shows the chip puller used in the invention. In a preferred embodiment, a chip puller 14 containable in recess 13 shown in FIG. 1. The chip puller 14 has a form similar to a pair of tweezers with hooks 100, 102 on the end. Generally, the chip puller is a pseudo-cylindrical shape when in the closed position. In an alternative embodiment, the chip puller could be pivotably mounted to the interior of the housing 12 for rotation from the recesses 36.

Figure 5:
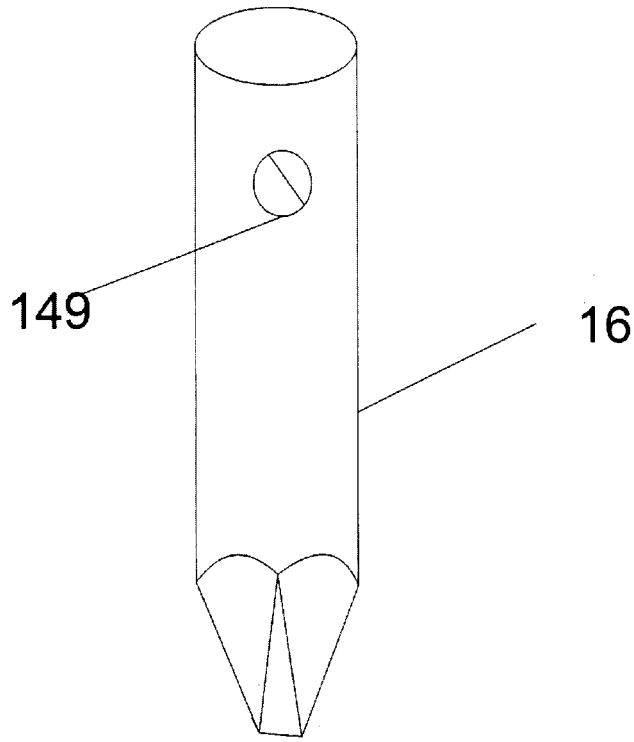
FIG. 5 is a side view showing how a screwdriver of the invention is mounted to the body of the tool.

FIG. 5 is a side view showing how a screwdriver 16 of the invention with a slot 149 for attaching to the plate, using a rivet through the slot 149.

Figure 6:
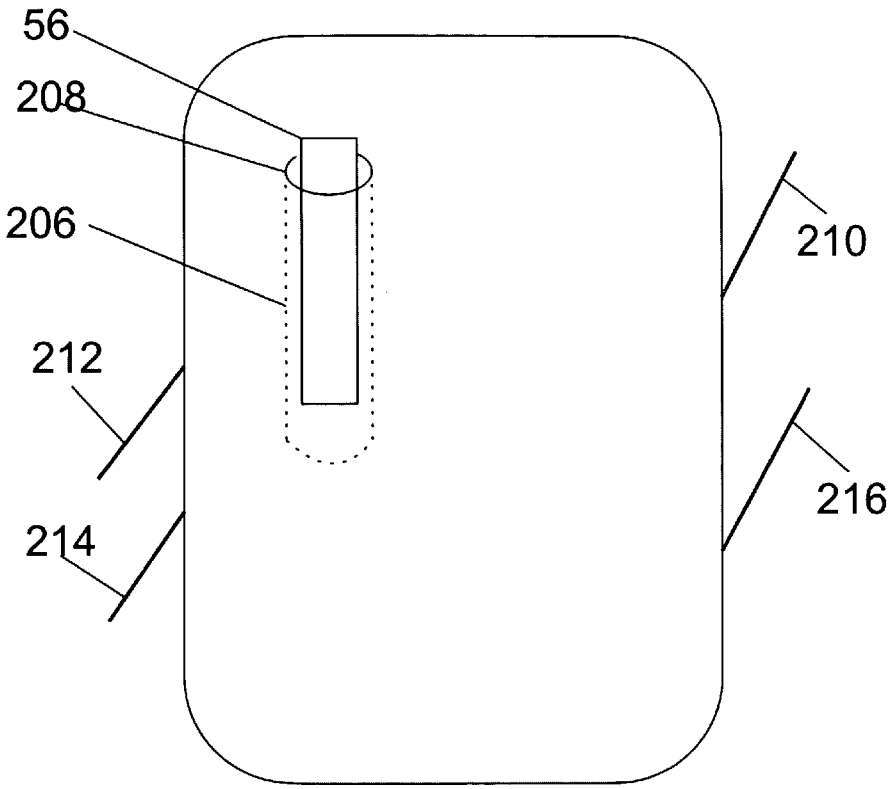
FIG. 6 is a view of a second cover plate of the invention with certain tools deployed.

FIG. 6 shows the tool can include a removable implement, such as a writing implement 56. In this embodiment, the tool would have a slot 206 with an opening 208 for storing the writing implement, shown in FIG. 6.

It is also contemplated that the tool could include additional deployable implements pivotably secured to the tool that is at least one of the group consisting of a cutting blade 210 and a cap lifter 212. The invention also contemplates having pivotably mounted a third screwdriver forming a large flat head 214 and a torx screwdriver 216.

While a multi-purpose tool formed in accordance with the principles of the present invention is particularly shown and described herein with reference to particular embodiments, it is to be understood that the invention may be used with many additions, substitutions, or modifications of form, structure, arrangement, proportions, materials, and components and otherwise, used in the practice of the invention, which are particularly adapted to specific environments and operative requirements without departing from the spirit and scope of the present invention. For instance, various other tools or other implements, such as an Allen Type, hex key-wrench or a clock or timing device, may be provided. The presently disclosed embodiments are therefore to be considered in all respects as illustrative and not restrictive, the scope of the invention being indicated by the appended claims, and not limited to the foregoing description.

While this invention has been described with emphasis on the preferred embodiments, it should be understood that within the scope of the appended claims, the invention might be practiced other than as specifically described herein.

What is claimed is:

1. A compact multiple function tool for use with computer systems comprising, a. a housing having a front plate and a back plate and an overall length of less than three inches, separated by interior plates connected by rivets;

b. as a unit, a plurality of implements connected to a housing, wherein the plurality of implements comprises:

i. a miniature flashlight;

ii. a chip puller;

iii. a first screwdriver having a small Phillips head with a length less than two inches;

iv. a second screwdriver forming a small flat head with a length less than two inches;

v. a continuity tester with a miniature indicator light;

vi. a miniature wire stripper;

vii. a miniature crimper; and viii. a laptop case cracker;

c. wherein the plurality of implements are pivotally coupled to the housing; and d. wherein the miniature flashlight is positioned on the front plate of the compact multiple function tool.

2. The compact multiple function tool of claim 1, further comprising a password mnemonic mounted on the front plate of the compact multiple function tool.

3. The compact multiple function tool of claim 1, further comprising a battery compartment for receiving a battery for the miniature flashlight.

4. The compact multiple function tool of claim 1, wherein the miniature wire stripper is able to strip wire a size less than or equal to 24-gage wire.

5. The compact multiple function tool of claim 1, further comprising an Ethernet connector tester with two connectors and a LED indicator for indicating a working circuit.

6. The compact multiple function tool of claim 5, wherein the Ethernet connector tester is a RJ45 connector.

7. The compact multiple function tool of claim 5, wherein the Ethernet connector tester is pivotably coupled to the compact multiple function tool such that pivoting of the Ethernet connector tester away from the compact multiple function tool permits access to the connector's interior.

8. The compact multiple function tool of claim 1, further comprising a cable pin insertion device.

9. The compact multiple function tool of claim 1, further comprising a removable writing implement.

10. The compact multiple function tool of claim 9, wherein the tool includes a slot for storing the removable writing implement.

11. The compact multiple function tool of claim 1, further comprising a deployable implement pivotally secured to the compact multiple function tool that consists of at least one member of the group consisting of: a cutting blade and a cap lifter.

12. The compact multiple function tool of claim 1, wherein the miniature flashlight includes a miniature flashlight actuator for activating and deactivating the miniature flashlight disposed on the front plate of the compact multiple function tool.

13. The compact multiple function tool of claim 1, wherein the miniature crimper is adapted for Ethernet cable and telephone cable crimping.

14. The compact multiple function tool of claim 1, wherein the continuity tester comprises two retractable wires, each wire having a contact for engaging a circuit, wherein the contacts connect to the miniature indicator light, wherein the miniature indicator light indicates signal continuity in a test part.

15. The compact multiple function tool of claim 1, further comprising a third screwdriver forming a large flat head screwdriver pivotally connected to the compact multiple function tool.

16. The compact multiple function tool of claim 1, further comprising a torx screwdriver pivotally connected to the compact multiple function tool.

* * * * *